US005835014A

United States Patent [19]

Morello

[11] Patent Number: 5,835,014

[45] **Date of Patent: *Nov. 10, 1998**

[54] ANNUNCIATOR SYSTEM

[76] Inventor: Peter S. Morello, 141, Rocky Pound Rd., Plymouth, Mass. 02360

[ * ] Notice: The terminal 16 months of this patent has been disclaimed.

[21] Appl. No.: 441,433

[22] Filed: May 15, 1995

[51] Int. Cl.[6] ..... E05B 45/06

[52] U.S. Cl. ..... 340/542; 340/286.11; 340/296; 340/302; 70/DIG. 49

[58] Field of Search ..... 340/286.11, 296, 340/301, 302, 306, 686, 542, 545, 457, 568; 70/DIG. 49, DIG. 54, DIG. 56

[56] References Cited

U.S. PATENT DOCUMENTS

| | | | |
|---|---|---|---|
| 3,685,036 | 8/1972 | Torok | 340/542 |
| 4,333,074 | 6/1982 | Sutherland et al. | 340/543 |
| 4,540,269 | 9/1985 | Nishiyama | 340/545 |
| 4,864,279 | 9/1989 | Cooper | 340/686 |
| 5,168,258 | 12/1992 | Radke | 340/542 |
| 5,191,314 | 3/1993 | Ackerman et al. | 340/542 |
| 5,461,360 | 10/1995 | Guim et al. | 340/542 |

FOREIGN PATENT DOCUMENTS

| | | | |
|---|---|---|---|
| 3406385 | 8/1985 | Germany | 340/542 |

OTHER PUBLICATIONS

Clegg Line Catalog, © 1993 "Telephone Ringing Business Card Holders".

*Primary Examiner*—Brent A. Swarthout

[57] ABSTRACT

Protection of manual override lock and key systems for an electronic security system is provided by an annunciator system which is activated when access to a manual override keyhole is attempted.

5 Claims, 4 Drawing Sheets

ANNUNCIATOR SYSTEM

BACKGROUND OF THE INVENTION

This invention relates to annunciator systems intended to signal the opening of a locked compartment or secured space.

Many security systems are activated electronically and usually function flawlessly. However it is not unknown for the electricity that powers these systems to fail and the consequence is that the systems are locked out until the power is restored. This can have disastrous consequences for example in a store with a large number of "point-of-sale" (or POS) machines that cannot be opened, perhaps with large amounts of cash inside. To counteract this, most such systems have a manual override allowing the secured space, in this case a cash drawer, to be opened by use of a key.

This sensible approach however causes a gap in the security system in that anyone acquiring a key now has the power to override many of the sophisticated built-in electronic security systems once the power supply is interrupted. In some cases owners who have been victimized by thieves operating in this manner have disabled the manual override locks for example by taking them out altogether or by fixing metal strips across the keyhole. It would appear that the preference is to run the risk of being locked out of the secured space for a period rather than the risk of being robbed.

Applicant has now discovered a simple, easily installed and inexpensive annunciator system that prevents unauthorized use of a manual override key from going undetected. The system permits those in charge of security to use the override key without complex procedures and to take appropriate safety measures. The cost of the system is such that it is readily within the price range of ordinary customers, can be easily installed in a pre-existing system, and requires minimum maintenance.

DESCRIPTION OF THE INVENTION

The present invention comprises an annunciator system protecting a lock and key security system comprising a keyhole in an outer wall of a secured space which annunciator system comprises:

a) a first member adapted to be secured to said outer wall around said keyhole and having an aperture permitting access to said keyhole;

b) a second member attached to the first member and covering the aperture in the first member when in the normal secured position but moveable with respect to the first member so as to expose the aperture; and c) an alarm system activated when the second member is moved out of the secured position to expose the aperture in the first member.

When in use the second member prevents use of the keyhole to permit manual override. In order to activate this override the second member must be moved to expose the keyhole. This will of course activate the alarm system but if the one using the key is authorized, appropriate security personnel will already have been alerted and no trouble will ensue. After the secured space has been opened, the key can be removed and the second member restored to the original position thereby deactivating the alarm system. If the manual override is being used surreptitiously however, the response of security personnel alerted by the alarm may be enough to prevent the robbery. In some cases the mere presence of the annunciator system will deter attempts at theft.

The second member may be connected by a hinge along one edge thereof, said hinge being connected also to an opposed edge of the first member so that the aperture is exposed by moving the second member out of face to face register with the first member. With some materials, such as plastic, a line scored in the surface creates a flexible joint between first and second members and supplying the hinge function. Alternatively the second member may be mounted on a spindle or post projecting from the first member such that, instead of lifting the second member to expose the keyhole, the second member is rotated about the spindle or post with the same effect. The second member may also move in the plane of the second member by a sliding motion within tracks affixed to and forming parts of the first member. Other means of closing access to the keyhole in a reversible manner can readily be conceived by those of skill in the art.

The third component of the system of the invention is an alarm system which is activated by the relative movement of the second and first members. In some cases this can be built into the secured space with an independent power source but more frequently it will be preferably operated by its own battery which is integral with the unit since this will be independent of the very power source the possible failure of which gives a reason for the development of the present annunciator system. In preferred systems the alarm is attached to either the first or the second member. Modern electronics and solid circuitry allows the alarm system to be remarkably compact and easily able to fit into a very confined space. The alarm system is preferably housed within either the first or second member which in such case would include an enclosure of suitable dimensions to accomodate the system. This enclosure may be made accessible, for example to replace a battery, but in many cases the device may be available at such an inexpensive price that, with the longevity of modern batteries and the infrequency with which the power source will be used, it is more cost effective to have the alarm system sealed within the enclosure such that the annunciator is replaced completely rather than serviced. This also has the advantage of making the annunciator more resistant to tampering.

While the alarm system may be accommodated in either the first of second members, it is usually preferred that it be located in an enclosure forming part of the second member.

Activation can be by any convenient mechanism but since relative movement between first and second members is the triggering mechanism, it is often useful to provide that such movement moves an insulating strip permitting contact between two plates previously separated by the insulating strip such that a circuit activating the alarm is completed. Other equivalent activating mechanisms will be apparent to the skilled man in the art.

Since accidental movement in normal use can occur, it is preferred that the annunciator is not activated until just before the keyhole is exposed sufficiently for the key to be inserted. Where the second member operates on a hinge, the alarm is preferably not activated until the angle at the hinge connecting the members is at least 30°, for example between about 45° and about 60°. Where the second member moves on a spindle or on runners, the alarm is preferably activated just before any portion of the keyhole is exposed.

The annunciator of the invention is affixed to the outer wall of the secured space and over the keyhole allowing manual override of the security system. It may be permanently affixed as by rivets or welding but it is often preferred to use an adhesive since the devices are primarily useful to retrofit existing security systems. The adhesive however is preferably one that will not, during normal conditions of use become embrittled or weak such that it can readily be removed by a sharp blow. Such an adhesive may be for example a rapidly curing pressure sensitive adhesive of a permanent adhesive such an epoxy resin. Many other suitable adhesives will be obvious to a skilled man. It is however also sometimes preferred that the device have a second mechanism that activates the alarm when the device is removed from the outer wall of the secured space. This is intended to protect against unauthorized removal of the annunciator to defeat the system.

The material from which the annunciator of the invention may be constructed is not a necessary limitation. It is preferred that the system is sturdy enough to withstand normal wear and tear in the position in which it is located. It can therefore be made of metal or plastic. It may however be made out of less durable materials such as heavy duty cardboard or wood in appropriate circumstances. It is also possible to make the exposed portion of a different material from that which is covered in normal operation. In this way the most suitable material for each specific portion of the system may be employed.

In a preferred embodiment the body of the device is constructed entirely of metal and is stamped out from a single sheet of metal or plastic. This allows the use of very simple and inexpensive construction techniques.

DRAWINGS

DESCRIPTION OF PREFERRED EMBODIMENTS

The invention is now described with particular reference to the drawings. This is however not intended to imply any necessary limitation on the essential scope of the invention since the description is intended solely for the purpose of exemplification.

Figure 1:
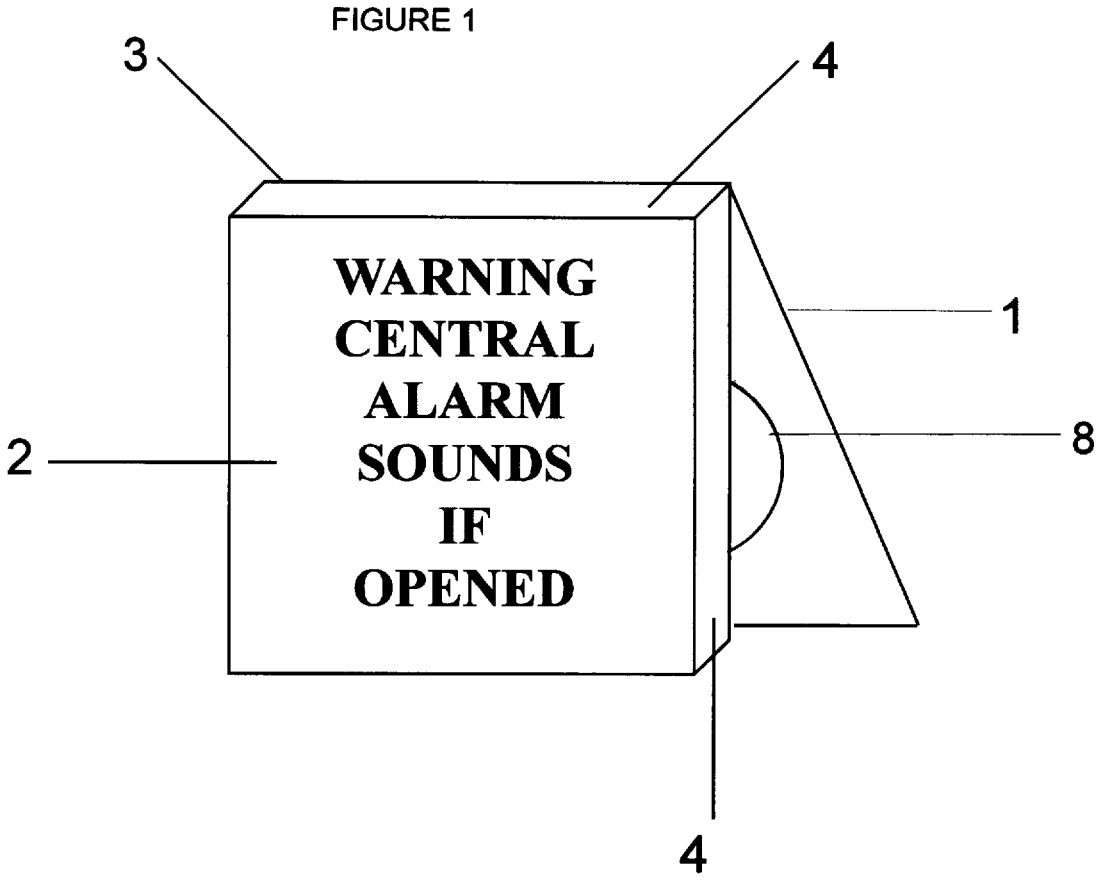
FIG. 1 is a perspective view showing an alarm system according to the invention in the partially opened position.
Figure 2:
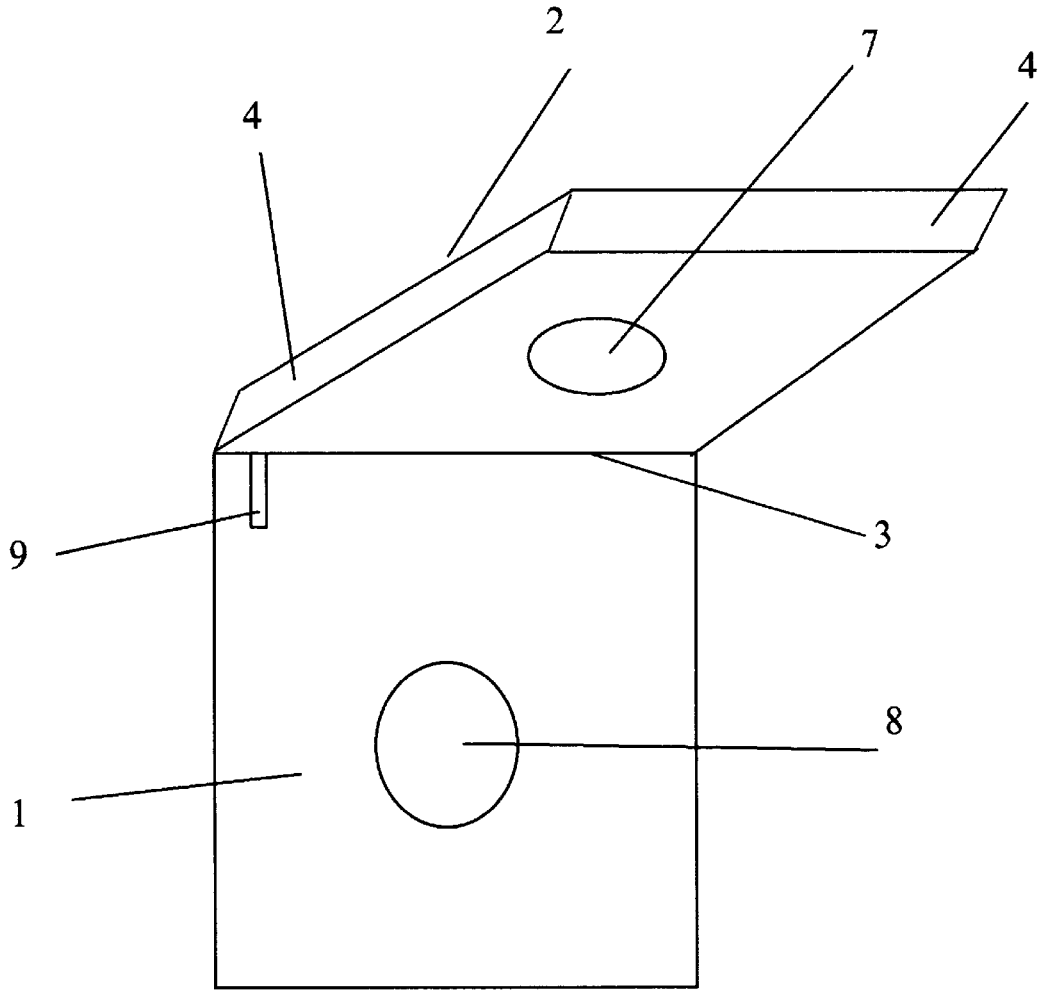
FIG. 2 is a perspective view of the system shown in FIG. 1 in the fully open position.
Figure 3:
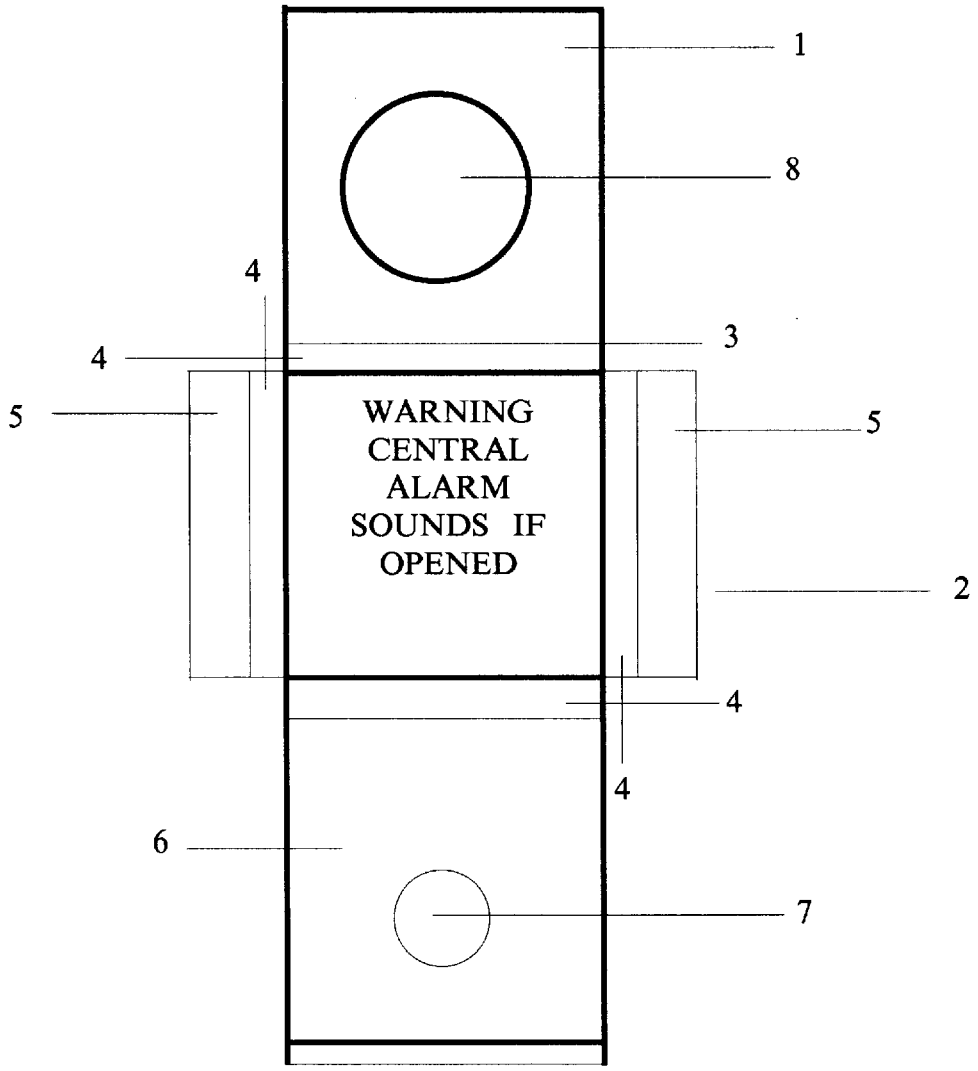
FIG. 3 shows the alarm system of FIG. 1 opened out to show a plan view of the construction.

The annunciator illustrated in the Drawings comprises a first member, 1, attached to second member, 2, by a hinge line, 3. This hinge may be a separate item but it is often preferably a line scored in the material to permit relative movement of the members. FIG. 3 shows the sheet from which the annunciator is stamped in a single operation. In this Figure, the side of member, 1, that is shown, is the side attached directly to the wall of the secured space. Member, 1, is provided with a circular aperture, 8, located centrally so as to provide access to a key hole, access to which is to be protected by the annunciator of the invention. In the device illustrated, it will be appreciated that the alarm system is carried within the second body member. To provide space for this the second body member is formed with side walls, 4, and a closure member, 6, which is provided with an aperture, 7. The side wall and the closure member are folded at right angles and sealed together so as to form a container which encloses the alarm system. The aperture in the closure member allows the sound generated by the alarm system to be heard more clearly. Tabs, 5, on the opposed side walls are folded over the closure member and bonded to it to retain it in place. In FIG. 3 the face of the second member that remains exposed is provided with appropriate warning language.

Figure 4:
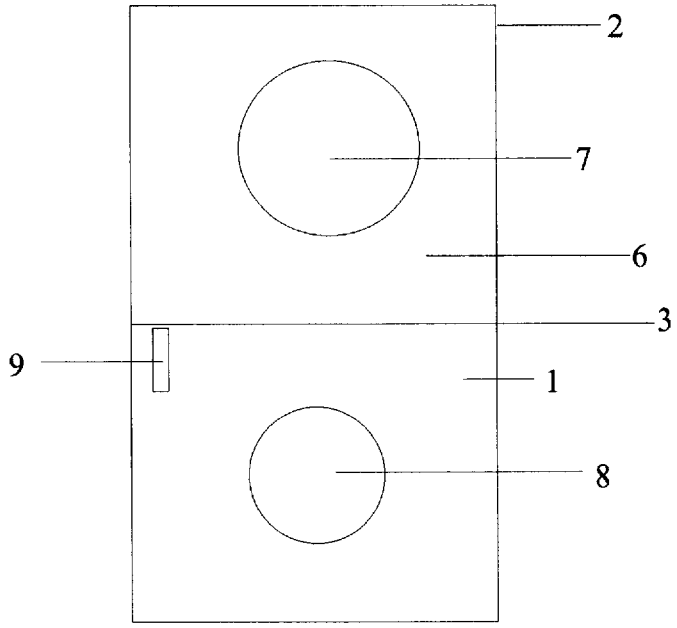
FIG. 4 shows a front view of the annunciator with the second member fully opened to expose the protected keyhole.

FIG. 4 illustrates the annunciator in the fully opened position. This exposes a strip of insulating material, 9, which enters the container portion of the second member housing the alarm system. The strip separates two spring loaded contacts, (not shown), within the alarm system that contact opposite sides of the strip. In normal operation with the annunciator in the closed position, this prevents completion of a circuit activating the alarm. The strip is provided with an aperture, not shown, which is normally out of register with the contacts but which, when the second member is moved by a specified amount, is brought into register with the contacts which are thus able to come into contact through the aperture in the strip thereby activating the alarm.

In the illustrated annunciator the alarm is a siren sound but this could alternatively be a bell or a recorded announcement or some other alerting device. It could even be used to emit a radio signal detectable by a central system capable of sounding a more general alarm.

Other variations on the annunciator described above may be devised without departing from the essence of the idea. It is intended that all such variations be covered by the properly understood scope of this invention.

What is claimed is:

1. An annunciator protecting a secured space protected by an electronic alarm system comprising a lock and key with the keyhole located in an outer wall of the secured space and providing a means for manually overriding the system and accessing the secured space in the event the electronic alarm system is inactivated, which annunciator comprises:

a) a first member secured to said outer wall around said keyhole and having an aperture permitting access to said keyhole to override the electronic alarm system and to access the secured space when the system is inactivated;

b) a second member attached to the first member and covering the aperture in the first member when in the normal secured position but moveable with respect to the first member so as to expose the aperture; and c) a self-contained alarm system housed within the second member activated when the second member is moved out of the secured position to expose the aperture in the first member.

2. An annunciator according to claim 1 in which the second member is in hinged relationship to the first member.

3. An annunciator according to claim 2 in which the alarm system is activated when the angle between the first member and the second member as a result of movement about the hinge is from about 45° C. to about 60° C.

4. An annunciator according to claim 1 in which the first member is secured to the outer wall of the secured space by means of an adhesive.

5. An annunciator according to claim 1 in which the alarm system is activated by removal of an insulating strip from between two contacts completing a circuit which includes an alarm generating device.

* * * * *